US009835039B2

(12) United States Patent
Feldmann et al.

(10) Patent No.: US 9,835,039 B2
(45) Date of Patent: Dec. 5, 2017

(54) SLIDE RING SEAL

(71) Applicant: MTU Aero Engines AG, Munich (DE)

(72) Inventors: Manfred Feldmann, Eichenau (DE); Norbert Schinko, Munich (DE); Janine Sangl, Dachau (DE)

(73) Assignee: MTU Aero Engines AG, Munich (DE)

( * ) Notice: Subject to any disclaimer, the term of this patent is extended or adjusted under 35 U.S.C. 154(b) by 458 days.

(21) Appl. No.: 14/249,056

(22) Filed: Apr. 9, 2014

(65) Prior Publication Data

US 2014/0321969 A1 Oct. 30, 2014

(30) Foreign Application Priority Data

Apr. 24, 2013 (EP) ..... 13165101

(51) Int. Cl.

| | |
|---|---|
| ***F04D 27/02*** | (2006.01) |
| ***F01D 11/02*** | (2006.01) |
| ***F01D 11/00*** | (2006.01) |
| ***F01D 11/12*** | (2006.01) |
| ***F01D 25/24*** | (2006.01) |
| ***F01D 25/26*** | (2006.01) |

(52) U.S. Cl.

CPC ..... *F01D 11/025* (2013.01); *F01D 11/005* (2013.01); *F01D 11/122* (2013.01); *F01D 25/24* (2013.01); *F01D 25/246* (2013.01); *F01D 25/26* (2013.01)

(58) Field of Classification Search

CPC .... F01D 11/025; F01D 11/005; F01D 11/122; F01D 25/24; F01D 25/246; F01D 25/26; F01D 25/12; F01D 25/14; F01D 25/145; F01D 11/16; F01D 11/12–11/127; Y02T 50/676

USPC ..... 415/1, 230, 73.41, 178, 173.2–173.5; 277/414–415, 421

See application file for complete search history.

(56) References Cited

U.S. PATENT DOCUMENTS

| | | | | |
|---|---|---|---|---|
| 3,656,862 A * | 4/1972 | Rahaim | F01D 25/246 415/173.2 |
| 6,139,263 A * | 10/2000 | Klingels | F01D 5/225 415/173.5 |
| 6,146,091 A * | 11/2000 | Watanabe | F01D 9/04 415/111 |
| 2005/0232752 A1 * | 10/2005 | Meisels | F01D 25/24 415/116 |

FOREIGN PATENT DOCUMENTS

| | | |
|---|---|---|
| EP | 0937864 A2 | 8/1999 |
| EP | 0940562 | 9/1999 |

* cited by examiner

*Primary Examiner* — Jason Shanske
*Assistant Examiner* — Kelsey Stanek
(74) *Attorney, Agent, or Firm* — Davidson, Davidson & Kappel, LLC

(57) ABSTRACT

A turbomachine in the form of a stationary gas turbine or an aircraft engine, respectively a housing structure therefor; the housing structure including an outer housing wall (1) and an inner wall (2) defining the flow channel; and a hollow space (4) being formed between the inner wall and the outer housing wall. The hollow space is separable into at least two regions (5, 6); a movable wire element (slide ring seal) (10, 10'), which is adapted to rest against the contact faces (8, 9), being configured in the hollow space for purposes of the separation.

17 Claims, 2 Drawing Sheets

SLIDE RING SEAL

This claims the benefit of European Patent Application EP13165101.0, filed Apr. 24, 2013 and hereby incorporated by reference herein.

The present invention relates to a housing structure for a turbomachine that surrounds a flow channel for a fluid that flows therethrough. The housing structure includes an outer housing wall and an inner wall defining the flow channel, a hollow space being formed between the inner wall and the outer housing wall. The present invention also relates to a corresponding turbomachine, such as a stationary gas turbine or an aircraft engine.

BACKGROUND

Turbomachines, such as stationary gas turbines or aircraft engines, are generally known from the related art and are used in a multitude of ways. Accordingly, many components of turbomachines have already been highly developed and have numerous mutually adapted property profiles.

This also holds for the housing structures of turbomachines that must satisfy diverse tasks in terms of relieving, respectively accommodating pressure and temperature differences between the flow channel of the turbomachine, in which the operating fluid, such as air and combustion gases, is conducted, and the external environment.

However, there is an ongoing need to further improve such housing structures since more stringent demands are being placed on the relevant components, respectively component designs, particularly with regard to improving efficiency.

Thus, for example, sealing and insulation elements are used in housing structures, but they are subject to wear, however. Particularly in the case of high-speed, low-pressure turbines in turbomachines that are being increasingly used to enhance efficiency, the sealing and insulation elements in the housing structure are subject to increased wear due to the higher pressure loads. It is, therefore, desirable to find a remedy therefor since high costs, in particular, high maintenance costs are entailed when the components are subject to high wear levels, as worn components need to be replaced.

SUMMARY OF THE INVENTION

It is an object of the present invention to provide a housing structure that will make it possible to reduce the wear the components of the housing structure are subject to, particularly in the low-pressure turbine field. At the same time, the housing structure should have a simple design and reliably fulfill the remaining tasks thereof.

In a housing structure having an outer housing wall and an inner wall defining the flow channel, a hollow space being formed between the inner wall and the outer housing wall, the present invention provides that the hollow space be configured to be separable by a sealing element, in particular, in the axial direction of the turbomachine, to allow different pressure conditions in the hollow space. The separation is to be made possible, in particular, in the area of what is generally referred to as an outer air seal, thus, in a sealing area between the rotor blade tips and the inner wall of the housing structure.

A movable wire element, which is adapted to rest against contact faces, respectively sealing surfaces, is to be configured as a separation, respectively a sealing element. in the hollow space, in order to effect the separation, respectively sealing. The movability of the wire element is understood here to mean that the wire element itself is able to move as a body, thus, translationally or rotationally, or that a movement induced by a movement of at least parts of the wire element takes place in response to a deformation of the wire element.

It has been found that such a design makes it possible to significantly reduce the wear the components in the housing structure are subject to. The movable wire element is not permanently clamped or positioned in the hollow space, rather is movable within certain limits to be able to accommodate the different pressure and temperature conditions during operation and adapt to the surrounding components.

The movable wire element may be configured to extend at least partially circumferentially around the flow channel, a completely circumferential configuration being advantageous, in particular, to be able to provide the sealing action over the entire circumference of the housing structure.

Accordingly, the movable wire element, which may also be referred to as slide ring seal, may have an annular shape, in particular. However, to render possible a circumferential deformability, respectively movability, the slide ring seal, respectively the movable wire element may be slotted at least once, i.e., have a circumferentially interrupted configuration.

Additionally or alternatively, the wire element may be made of an elastic material that renders possible an elastic deformation of the movable wire element in response to the operating conditions, to allow an adaptation to adjacent components and, in particular, contact faces that are provided for forming a seal.

In particular, the design of the housing structure may be such that the hollow space features a cross-sectional narrowing where the contact faces are at least partially configured that, together with the movable wire element, form the seal.

The movable wire element, respectively the slide ring seal and, thus, also the cross-sectional narrowing of the hollow space may be configured in one area of the housing structure that corresponds to the area where an abradable coating for cooperating with the rotor blade tips is configured in the flow channel. In other words, the movable wire element may be configured in the area of what is generally referred to as an outer air seal since, in this area, especially high pressure differences may occur that may be suitably accommodated by the slide ring seal in the housing structure.

The slide ring seal may have any desired cross section, such as a circular, semi-circular or polygonal. The shape of the cross section may be influenced by the adjacent components. Moreover, the slide ring seal may be in the form of a solid body or a hollow body, thus, for example, in cross section, be designed as a solid cylinder or as a hollow cylinder.

The movability of the slide ring seal may be provided, in particular, axially and/or circumferentially; on the one hand, the circumferential movability being able to include a rotation about the longitudinal axis of the flow channel, as well as a linear expansion, respectively circumferential widening. The axial movability may encompass an axial displacement, as well as an axial deformation, for example, an elastic deformation in response to a pressing against the contact faces.

The movement of the slide ring seal is limited by the adjacent components. Under operating load, the movement is limited in that the sealing element is always pressed against the two right-angled sealing surfaces. Thus, movements of the two sealing surfaces relative to one another may also be compensated by the sealing element.

To limit the axial displacement of the slide ring seal, the hollow space, in which the slide ring seal is configured, may include at least one retaining element that projects radially into the same, thereby making it possible to limit the displacement path for the slide ring seal.

BRIEF DESCRIPTION OF THE DRAWINGS

The enclosed drawing shows purely schematically in

DETAILED DESCRIPTION

Other advantages, characteristics and features of the present invention will become apparent from the following detailed description of the exemplary embodiments. The present invention is not limited thereto, however.

Figure 1:
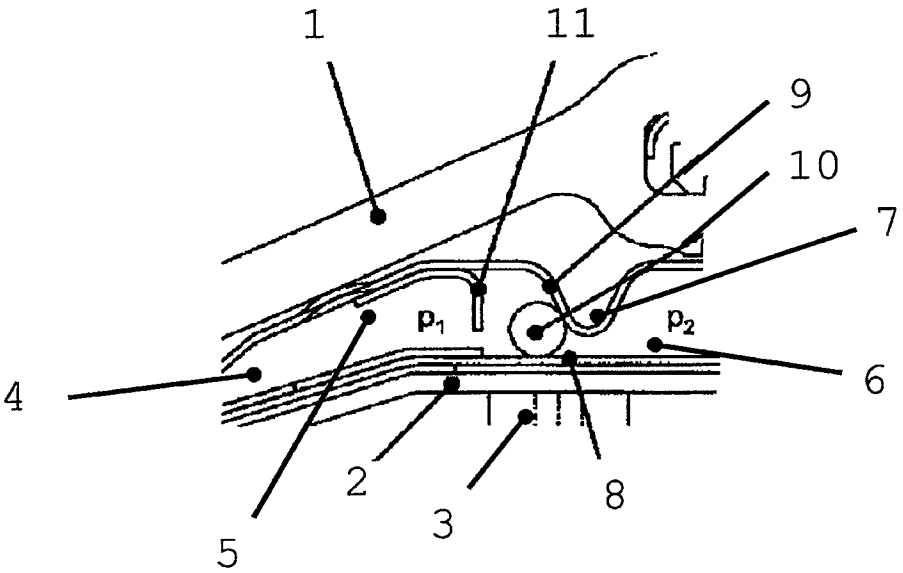
FIG. 1: a partial sectional view of a first specific embodiment of a housing structure in accordance with the present invention; and in FIG. 2: a partial sectional view of a second specific embodiment of a housing structure in accordance with the present invention.

In a partial sectional view, FIG. 1 shows a housing structure of an aircraft engine having an outer housing wall 1 and an inner wall 2 that extend circumferentially around a flow channel, in which the fluid of the turbomachine, thus, for example, the combustion gases of an aircraft engine, is conveyed in order to drive rotor blades.

To avoid drive losses for the rotor blades resulting from the combustion gases flowing past laterally, to the extent possible, the rotor blades are configured with the tips thereof in a way that does not allow any gap or only a small gap between the inner side of inner wall 2 and the tips of the rotor blades. Accordingly, an abradable coating 3, which is in contact with the tips of the rotor blades, is preferably configured on inner wall 2, which may also be referred to as what is generally known as a liner segment in order to form what is generally referred to as an outer air seal (OAS). The driving of the rotor blades creates a pressure difference in the flow channel between the inflow side of the rotor blades and the outflow side thereof.

Besides inner wall 2, the housing structure includes an outer housing wall 1, as well as elements configured therebetween, such as thermal shields, insulation elements or hollow spaces 4, and has the task of relieving, respectively accommodating the pressure and temperature differences between the flow channel and the external environment during operation of the turbomachine. Such a hollow space 4 may be used, for example, for conducting cooling air and for accommodating corresponding components, to be able to realize the temperature difference between the outer side of the outer wall and the inner side of the inner wall.

In the area of the abradable coating, respectively in the area of the rotor blades, which effect a corresponding pressure drop in the flow channel, hollow space 4 is likewise partitioned in accordance with the present invention into two regions 5 and 6 in which different pressure conditions p1 and p2 are to be adjusted in the flow channel in correspondence with the pressure conditions in the flow channel, for example, to prevent hot gas from being drawn in from the flow channel in response to shocks that occur at segmented inner wall 2. Particularly in the case of high-speed, low-pressure turbines, substantial pressure differences occur in the area of the outer air seal that may be accommodated by an appropriate sealing of separable regions 5 and 6.

For that reason, in the illustrated exemplary embodiment of FIG. 1, an indentation 7 is configured in hollow space 4 between separable regions 5 and 6 that results in a reduction in cross section of hollow space 4, so that, at indentation 7, a movable wire element 10, what is generally referred to as a slide ring seal, may be configured, which is adapted to rest against contact faces 8 and 9, that are formed, on the one hand, on indentation 7 and, on the other hand, on inner wall 2 or a thermal shield or the like configured thereon. Since in the case of a flow direction of the fluid, respectively hot gas, in FIG. 1 from left to right, pressure p1 is greater than pressure p2, slide ring seal 10 is automatically pressed against contact faces 8 and 9 in order to thereby effect a separation of regions 5 and 6, as well as a sealing thereof.

In the illustrated exemplary embodiment, the cross section of the wire element is circular, and the wire element is designed as a solid body, thus, in the form of a curved solid cylinder, respectively torus.

In the same way as inner wall 2, respectively outer housing wall 1 and the components provided therebetween, wire element 10 is configured to extend circumferentially around the flow channel, so that slide ring seal, respectively wire element 10 may have an annular shape.

However, in the circumferential direction, the ring may feature one discontinuity to allow it to widen and contract circumferentially, i.e., be able to move. This is advantageous in order to compensate for the temperature fluctuations occurring during operation and the resulting linear changes in length.

An axial movability of slide ring seal 10 is also provided, thus, in the representation of FIG. 1, from left to right and vice versa, to avoid a distortion of slide ring seal 10, and to make possible a free, independent resting against contact faces 8, 9, depending on the operating state of the flow system. Moreover, slide ring seal 10 may be made of a material that is elastic, such as an elastic, metallic material, especially in consideration of the operating conditions, to render possible a simple deformability which advantageously results in slide ring seal 10 being adaptable to the surrounding components and, in particular, contact faces 8, 9.

Since the movable wire element, respectively slide ring seal 10 is not configured to be fixed in place, rather to at least feature a certain free movability, in particular, axially and circumferentially, a holder 11, which extends radially into hollow space 4, is provided in hollow space 4 and restricts the axial movability of slide ring seal 10 and slide ring seal 10 at the location of use. This holder 11 may be designed as a separate component or be integrated in adjacent components.

Figure 2:
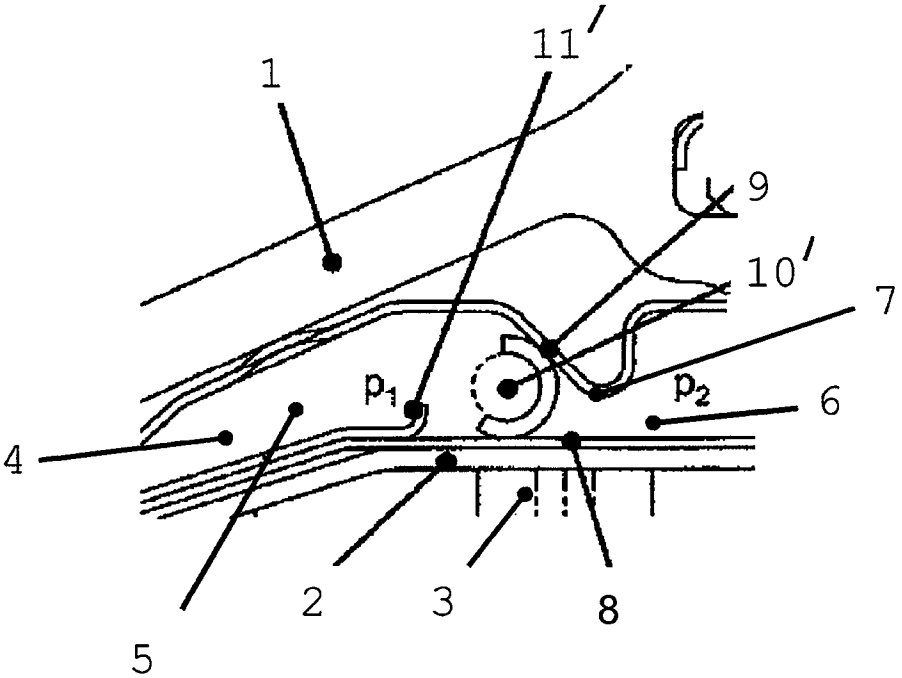

A second specific embodiment of a housing structure according to the present invention is shown in FIG. 2. To a large degree, the specific embodiment of FIG. 2 is identical to that of FIG. 1, so that like parts are denoted by the same reference numerals, and there is no need to repeat the description of these components. Thus, the specific embodiment of FIG. 2 is discussed in detail merely in terms of the differences from the specific embodiment of FIG. 1.

In comparison to the specific embodiment of FIG. 1, FIG. 2 is essentially distinguished by the form of slide ring seal 10. Instead of a movable wire element having a full cylindrical cross section, as in FIG. 1, in the specific embodiment of FIG. 2, a semicircular wire element 10' is used; the cross sectional shape of wire element 10 of FIG. 1 being additionally illustrated by a broken line in the representation of FIG. 2.

Apart from the illustrated cross sectional shapes, the slide ring seal may have any desired cross sectional shapes that may be adapted to the predefined boundary conditions, so that, under certain ambient conditions, rectangular, square, polygonal or other freely formed cross sectional shapes, but also cross sectional shapes that change in the circumferential direction are conceivable.

The specific embodiment of FIG. 2 is further distinguished from that of FIG. 1 in terms of radially projecting holder 11', which, in the specific embodiment of FIG. 2, is configured on the side of the inner wall, while in the specific embodiment of FIG. 1, holder 11 projects inwardly from the outer side. Here as well, holder 11' may be designed as a separate component or be integrated in adjacent components.

Although the present invention has been described in detail with reference to the exemplary embodiments, it is self-evident to one skilled in the art that it is not limited thereto, rather that variations thereof are possible in that individual features may be omitted or different combinations of features may be implemented, without departing from the protective scope of the claims below. The present disclosure encompasses any combination of the individual features presented here.

What is claimed is:

1. A housing structure for a turbomachine, the housing structure surrounding a flow channel for a fluid and comprising:

an outer housing wall and an inner wall defining the flow channel, a hollow space being formed between the inner wall and the outer housing wall, the hollow space having an indentation, the hollow space separable into at least two regions; and a movable wire element adapted to rest against contact faces and being configured in the hollow space for purposes of separating the at least two regions, wherein the indentation is one of the contact faces; and an abradable coating for blade tips provided on one side of the inner wall, the movable wire element being configured on an opposite, facing away side of the inner wall in an area of the abradable coating;

wherein at least another one of the contact faces is a surface of the opposite facing-away side of the inner wall, or a surface of a shield configured on the opposite facing away side of the inner wall.

2. The housing structure as recited in claim 1 wherein the movable wire element extends at least partially circumferentially around the flow channel.

3. The housing structure as recited in claim 1 wherein the movable wire element has an annular shape.

4. The housing structure as recited in claim 1 wherein the movable wire element is deformable.

5. The housing structure as recited in claim 4 wherein the movable wire element is a slotted ring or is made of an elastic material.

6. The housing structure as recited in claim 1 wherein the hollow space has a cross-sectional narrowing where the contact faces are at least partially configured.

7. The housing structure as recited in claim 1 wherein the movable wire element has a circular or semi-circular or polygonal cross section.

8. The housing structure as recited in claim 1 wherein the movable wire element is in the form of a solid body or a hollow body.

9. The housing structure as recited in claim 1 further comprising at least one retaining element limiting axial movability of the movable wire element and projecting radially into the hollow space and included in the hollow space.

10. The housing structure as recited in claim 1 wherein the movable wire element is axially or circumferentially movable.

11. The housing structure as recited in claim 1 wherein, during operation of the turbomachine, the movable wire element is pressed against the contact faces in response to pressure differences in the separable regions of the hollow space.

12. A turbomachine comprising the housing structure as recited in claim 1.

13. The turbomachine as recited in claim 12 wherein the turbomachine is a stationary gas turbine or an aircraft engine.

14. The turbomachine as recited in claim 12 wherein the housing structure is configured in the area of a low-pressure turbine.

15. A method for operating a turbomachine with the housing structure recited in claim 1, comprising: during operation of the turbomachine, pressing the movable wire element against the contact faces in response to pressure differences in the separable regions of the hollow space.

16. The housing structure as recited in claim 1 wherein the movable wire element is not permanently clamped or permanently positioned in the hollow space during operation.

17. The housing structure as recited in claim 1, wherein the movable wire element is movable axially and circumferentially in the hollow space during operation.

* * * * *